US005772724A

United States Patent [19]

Inoue et al.

[11] Patent Number: 5,772,724

[45] Date of Patent: Jun. 30, 1998

[54] HIGH PURITY TITANIUM PRODUCTION PROCESS

[75] Inventors: Hideaki Inoue, Nishinomiya; Masahiro Odagiri, Ibaraki, both of Japan

[73] Assignee: Sumitomo Sitix Corporation, Hyogo, Japan

[21] Appl. No.: 724,894

[22] Filed: Oct. 3, 1996

[30] Foreign Application Priority Data

Oct. 6, 1995 [JP] Japan ..... 7-259143
Oct. 12, 1995 [JP] Japan ..... 7-26039

[51] Int. Cl.[6] ..... C22B 34/12

[52] U.S. Cl. ..... 75/10.13; 75/10.19; 75/10.26; 75/10.28; 75/612; 420/590

[58] Field of Search ..... 75/10.19, 10.13, 75/10.26, 10.28; 420/590

[56] References Cited

U.S. PATENT DOCUMENTS

| | | | |
|---|---|---|---|
| 34,598 | 5/1862 | Shimotori et al. . | |
| 5,108,490 | 4/1992 | Yashimura et al. . | |
| 5,124,122 | 6/1992 | Wojcik | 75/10.26 |
| 5,196,916 | 3/1993 | Ishigami et al. . | |
| 5,204,057 | 4/1993 | Ishigami et al. . | |
| 5,232,485 | 8/1993 | Yoshimura et al. . | |

FOREIGN PATENT DOCUMENTS

| | | |
|---|---|---|
| 3-215633 | 9/1991 | Japan . |
| 4-246136 | 2/1992 | Japan . |
| 7-41890 | 2/1995 | Japan . |
| 7-258765 | 9/1995 | Japan . |

*Primary Examiner*—Melvyn Andrews
*Attorney, Agent, or Firm*—Armstrong, Westerman, Hattori, McLeland & Naughton

[57] ABSTRACT

The present invention provides a method for producing high-purity titanium from titanium sponge obtained by the Kroll process in which a core of the cylindrical lump of titanium sponge obtained with a weight less than 20–30% of that of the cylindrical lump is separated by cutting off from the lump a bottom portion, a top portion and a peripheral portion, and the core is cut by a press into grains of specific size, which are melted into ingot or refined by reaction with iodine. The high-purity titanium thus produced contains less than 300 ppm of oxygen and less than 10 ppm each of iron, nickel, chromium, aluminum and silicon, the balance being titanium and inevitable impurities; or less than 200 ppm of oxygen and less than 1 ppm each of iron, nickel, chromium, aluminum and silicon, the balance being titanium and inevitable impurities. Thus the invention provides titanium materials of very high purity suitable for thin film deposition as wiring of LSIs from titanium sponge obtained by the Kroll process.

18 Claims, 7 Drawing Sheets

6TON

8TON

10TON

LEGEND

Fe CONCENTRATION;

>1000ppm 600~1000ppm 400~600ppm 200~400ppm 100~200ppm <100 ppm

6TON

8TON

10TON

LEGEND

O2 CONCENTRATION;

>1000ppm 600~800ppm 400~600ppm 300~400ppm 200~300ppm <200 ppm

CLAD STEEL VESSEL

STAINLESS STEEL VESSEL

LEGEND

Ni CONCENTRATION;

≧60ppm | 40~59ppm | 20~39ppm | <20ppm

CLAD STEEL VESSEL

STAINLESS STEEL VESSEL

LEGEND

Cr CONCENTRATION;

≧60ppm | 40~59ppm | 20~39ppm | 20ppm

HIGH PURITY TITANIUM PRODUCTION PROCESS

BACKGROUND OF THE INVENTION

1. Field of the Invention

The present invention relates to the production process of high-purity titanium intended for wiring in semiconductor devices. More specifically, it relates to a process for producing high-purity titanium, which is useful for the target for forming thin films as wiring material in LSIs, either by melting or by purifying in a thermal decomposition reaction of titanium iodides, called simply the iodine process hereinafter, from titanium sponge obtained in the Kroll process.

2. Description of the Prior Art

Semiconductor devices have been exhibiting extensive increase in the degree of integration, which requires processing of fine patterns under 1 $\mu$m in size in very large scale integration circuits (VLSIs). Electrode materials employed in the production of VLSIs are shifting to those with high purities and high strengths. For example, high-purity refractory metals with low resistivities have been attracting attention as the alternatives to the conventional polycrystalline silicon, because the former will eliminate signal retardation due to excessively fine electrode wiring. Such refractory metals include molybdenum (Mo), tungsten (W) and titanium, as well as their silicides, among which titanium is the most promising because of its high specific strength, good machinability and high corrosion resistance.

The Kroll process is a widely used method for producing titanium commercially. The process reduces titanium tetrachloride ($TiCl_4$) with magnesium (Mg) as the reducing agent to obtain high-purity titanium sponge. It consists of a reduction stage, a vacuum separation stage and a crushing/mixing stage.

FIG. 1 shows schematically the Kroll process to obtain titanium sponge, and a process for producing titanium ingot from titanium sponge.

In the reduction stage (1) $TiCl_4$ is sprayed from a nozzle 2 into a reduction furnace 1, and reacted with molten Mg at about 900° C. The reaction occurs in a reaction vessel 3 made of stainless steel, which is tightly closed because the presence of oxygen or other impurities in the reaction mixture would result in contamination of titanium sponge. As a result, the Kroll process is a batch process with the reaction vessel constituting a lot. The reaction vessel 3 is usually made of austenitic stainless steel which shows high strength at elevated temperatures.

Magnesium is placed in the reaction vessel 3 and heated to melt after the atmosphere is completely replaced by argon. $TiCl_4$ is introduced in the vessel 3 containing molten Mg through the nozzle 2 to produce Ti and the byproduct $MgCl_2$, the latter being extracted from the vessel 3 as necessary. Eventually spongy or needle-like titanium containing unreacted Mg and remaining $MgCl_2$ is obtained in the vessel 3.

In the vacuum separation stage (2) the vessel 3 is placed in a separation furnace 4. While the inside of the vessel 3 is evacuated, the vessel is heated externally to evaporate the unreacted Mg and remaining $MgCl_2$ in the titanium sponge in the vessel 3. The evaporated components are recovered by a condenser 5 outside the furnace 4. The resultant titanium sponge, now free from the unreacted Mg and remaining $MgCl_2$, is extracted from the vessel 3, which consists a batch, in a form of a cylindrical lump.

The crushing/mixing stage ((3) and (4)) shapes the lump of titanium sponge by cutting off the top, bottom and peripheral portions of the lump, cuts the sponge with a press 6, and crushes to fine grains (½ inch or less in size) by a jaw crusher. The crushed titanium sponge is further mixed in a blender 7 for uniform quality, and ultimately stored in a tightly closed drums (not illustrated).

Titanium thus produced is in the form of spongy or needle-like grains, and is to be melted to form an ingot before being processed into pipes and sheets.

In the melting stage ((5), (6) or (7)) titanium sponge is cast into an ingot by the arc or electron-beam melting process.

For arc melting ((5) and (6)), the sponge is formed into a consumable electrode 11 which serves as an anode in the melting process. More specifically, the sponge goes through a press 8 to be formed into brickets 9, which are connected to each other by a welder 10 to give consumable electrodes 11. The electrode 11 is arc-melted in a vacuum, for example $10^{-2}$~$10^{-4}$ torr in pressure, into ingot 12.

In electron-beam melting (7) the sponge is directly melted in a vacuum of the same order. The sponge charged through a port 13 onto a hearth 14 is melted by an electron beam generated by an electron beam gun 15*a*. Impurities are evaporated while the melt obtained is retained on the hearth for a specified time. Subsequently the melt drops into a mold 16, which is irradiated by a beam from another electron-beam gun 15*b*, and solidifies as it is extracted from the bottom of the mold to produce ingot 12.

The Kroll process described earlier yields titanium sponge of relatively high levels of impurities, such as oxygen, iron, nickel or chromium; the purity is in a range of two to three nines (99–99.9%).

It is essential for titanium as LSI wiring materials to have a high purity. For example, the target for forming thin films as wiring in LSIs for 4-megabyte or higher memory devices require four- to five-nine titanium (99.99–99.999%) containing 300 ppm or less $O_2$ and under 10 ppm each heavy metals (Fe, Ni, Cr etc.). This means that the Kroll titanium with a purity of 99.9% cannot be used in 256-kilobyte, 1-megabyte or 4-megabyte devices, although it is acceptable as targets for wiring in 64-kilobyte memories.

The abovementioned dependence of device characteristics on titanium purity means that increase in the degree of integration of semiconductor devices, necessitating finer electrodes and denser arrangement of wirings, requires titanium of higher purity. In fact, in the development of integration from 16-megabit devices through 64- or 256-megabit to 1-gigabit devices, the purity requirement of titanium for targets for thin film formation as the wiring material in these devices has reached six nines (99.9999%) containing under 200 ppm $O_2$ and under 1 ppm each of Fe, Ni, Cr, Al and Si.

SUMMARY OF THE INVENTION

The present invention provides methods of producing high-purity titanium materials with reduced content of $O_2$, Fe, Ni, Cr and other impurities, which is suitable for LSI wiring, from titanium sponge obtained by the Kroll process.

The essential feature of the invention lies in the methods of producing titanium materials for LSI wiring with characteristics specified in (1)–(3) below.

(1) Method of producing titanium material with a purity of four nines (99.99%) or higher, in which the top and bottom portions, as well as peripheral portions of a certain thickness, are removed from the cylindrical lump of titanium sponge produced by the Kroll process, leaving a core with a weight less than 20% that of the whole lump which is further cut into grains 10–300 mm, or preferably 200–300 mm, in size by a cutting press before being melted.

Such a method produces a high-purity titanium material containing under 300 ppm $O_2$ and under 10 ppm each of Fe, Ni, Cr, Al and Si, the balance consisting of Ti and inevitable impurities.

(2) Method of producing titanium material with a purity of five nines (99.999%) or higher, in which the top and bottom portions, as well as peripheral portions of a certain thickness, are removed from the cylindrical lump of titanium sponge produced by the Kroll process using a reaction vessel made of clad steel, leaving a core with a weight less than 30% that of the whole lump which is further cut into grains 10–300 mm, or preferably 200–300 mm, in size by a cutting press before melted.

Such a method produces a high-purity titanium material containing under 300 ppm $O_2$ and under 10 ppm each of Fe, Ni, Cr, Al and Si, the balance consisting of Ti and inevitable impurities.

(3) Method of producing titanium material with a purity of six nines (99.9999%) or higher, in which a core of the titanium sponge produced by the Kroll process, obtained similarly as in (2) above, is cut into grains 10–300 mm in size, which is then purified by reaction with iodine (the iodine process).

Such a method produces a high-purity titanium material containing under 200 ppm $O_2$ and under 1 ppm each of Fe, Ni, Cr, Al and Si, the balance consisting of Ti and inevitable impurities.

DESCRIPTION OF PREFERRED EMBODIMENTS

The present inventors have made detailed studies on the contamination that limits the purity of the Kroll titanium sponge to two to three nines (99–99.9%) and devised appropriate remedies to establish methods for obtaining high-purity titanium as described in (1)–(3) above.

(1) Method of producing titanium material with a purity of four nines (99.99%) or higher a) Impurity Distribution in Titanium Sponge The distribution of impurities in the Kroll titanium sponge is not uniform; particularly that of oxygen and iron is very uneven.

FIG. 2 represents the distribution of iron and oxygen in a cylindrical lump (6–10 tonnes in weight) after the reduction and vacuum separation processes, shown for a quarter around its central axis. As is seen from the figure, iron in the lump is derived from the inner surface of the reaction vessel: iron is concentrated in the bottom and near the radial surface of the cylinder, while it is very low in concentration at the core. Similar distribution is observed also for Ni, Cr, Al and Si unless the reaction vessel is made of clad steel described below.

The distribution of oxygen is similar because oxygen contamination comes from ambient atmosphere on extraction of the sponge from the vessel: oxygen concentration is also low in the core. Therefore, titanium material with desired purity can be obtained by using solely the core of the cylindrical lump of titanium sponge for further processing.

The impurity distribution shown in FIG. 2 represents only a general pattern. Based on more detailed analysis of the distribution and the size of crushed titanium grains, as well as improvements in the crushing/mixing stage, as described below, the inventors have successfully defined the size of the core of sponge necessary to obtain four-nine (99.99%) titanium material.

Figure 1:
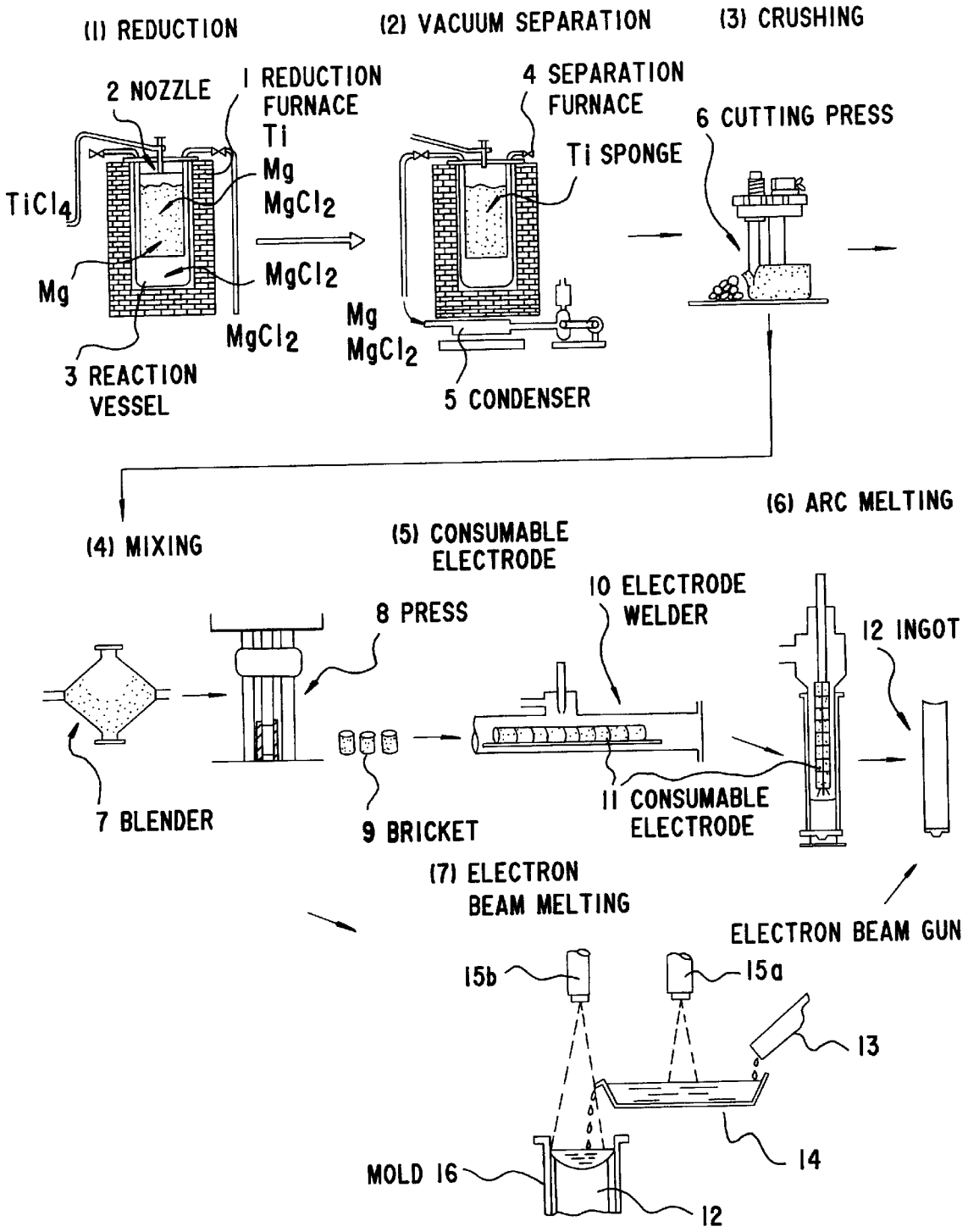
FIG. 1 is a schematic of the Kroll process and of the production processes of titanium ingot from titanium sponge.
Figure 2A:
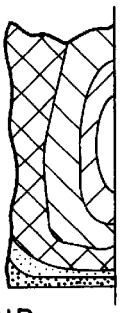
FIG. 2 represents the distribution of iron and oxygen in a cylindrical lump (6–10 tonnes in weight) after the reduction and vacuum separation processes, shown for a quarter around its central axis.
Figure 2B:
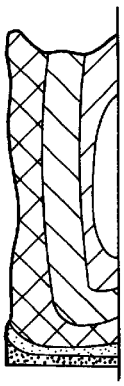
Figure 2C:
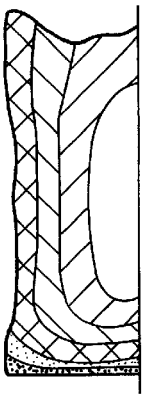
Figure 2C:
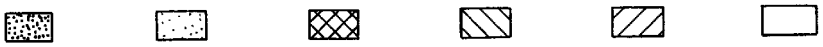
Figure 2D:
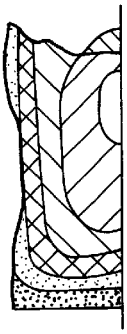
Figure 2E:
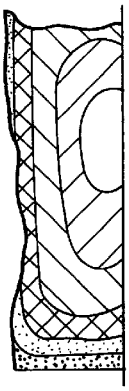
Figure 2F:
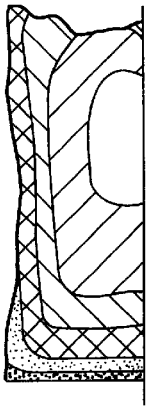
Figure 2F:
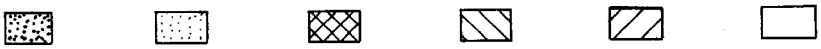
Figure 3A:
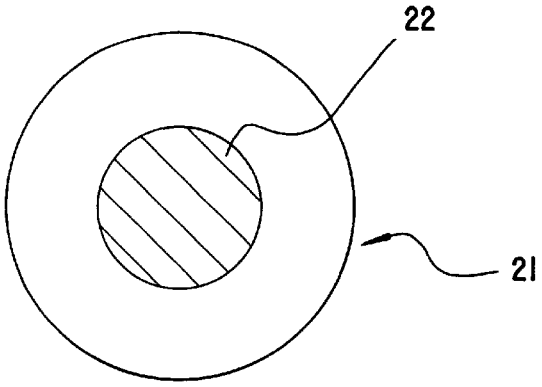
FIG. 3 illustrates the location of the core of the cylindrical lump of sponge produced by the Kroll process.
Figure 3B:
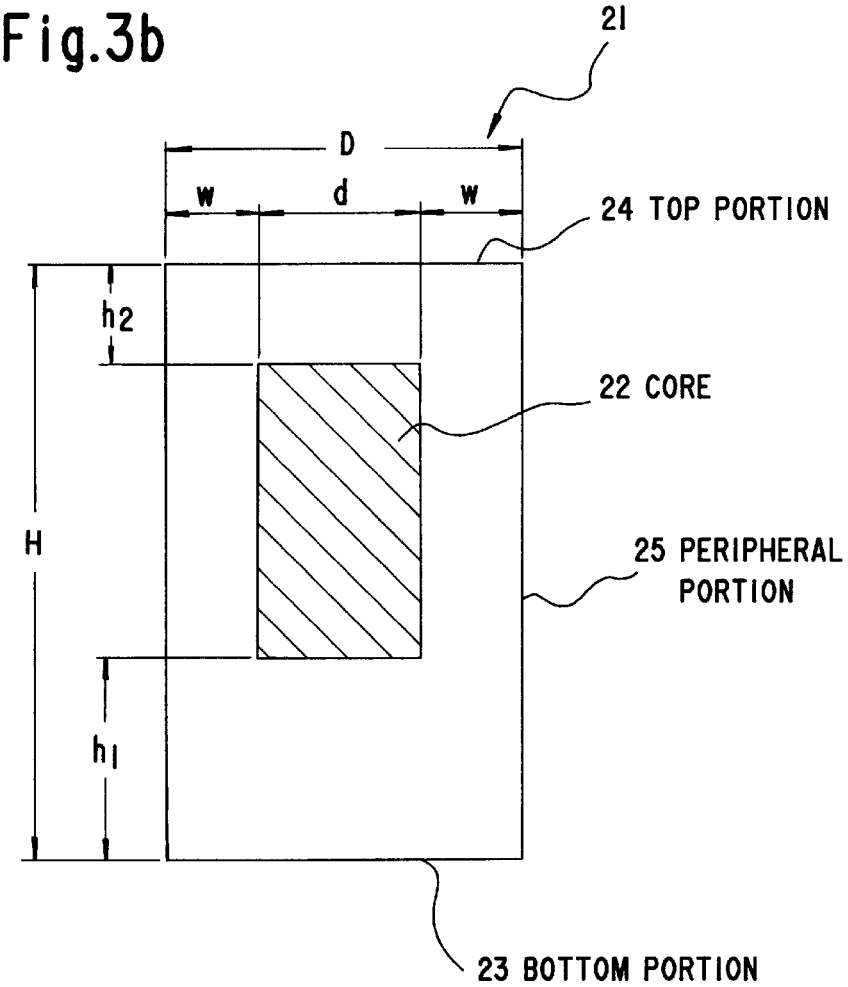

FIG. 3 illustrates the core of the cylindrical lump of the sponge used for further processing. The core is to be obtained by cutting off from the lump a bottom portion 23 with a height more than 25% of that of the cylinder ($h_1 \geqq 0.25H$), a top portion 24 with a height more than 10% of that of the cylinder ($h_2 \geqq 0.10H$), and a peripheral portion 25 with a thickness more than 20% of the diameter of the cylinder ($w \geqq 0.20D$), thus leaving a core with a weight less than 20% of the cylindrical lump.

Such core exerts a great influence on the characteristics of high-purity titanium material obtained therefrom. Ingot derived from the core with a weight less than 20% of that of the whole lump, as described above, provides four-nine (99.99%) titanium material containing less than 300 ppm $O_2$ and less than 10 ppm each of Fe, Ni, Cr, Al and Si. It is preferable for the weight of the core to be less than 10% that of the whole lump in order to stabilize further the desirable characteristics of the high-purity material.

b) Titanium Sponge Grain Size

Titanium sponge is conventionally cut by a press and crushed by a jaw crusher into fine grains (usually 10 mesh—½ inch). The purpose of crushing is to homogenize the composition for uniform quality, as well as to improve compression behavior in producing consumable electrodes. However, such small grain size increases the specific surface area of titanium sponge, rendering the material more susceptible to contamination due to oxygen and water in the atmosphere.

Heat generated due to deformation during crushing also contributes to contamination by oxygen.

Titanium sponge obtained from the core of the whole cylindrical lump has such a uniform composition that it needs no crushing for improving quality. Recent trends of higher pressure in compacting titanium sponge for arc melting, along with improved technique of electrode welding, allows preparation of consumable electrodes using large, uncrushed grains. Therefore, crushing is not an indispensable step anymore in preparing electrodes.

A feature of the invention is therefore elimination of the crushing and mixing steps in preparing consumable electrodes, namely formation of ingot directly from uncrushed titanium sponge. The specific surface area of titanium sponge is thus kept smaller to prevent contamination of the resultant ingot. More specifically, sponge is only cut by a press into grains 10–300 mm, or preferably 200–300 mm, in size.

c) Contamination during Crushing and Mixing

Another source of impurities in titanium sponge in the conventional method is fine dust generated by wear of parts of the cutting press and jaw crusher which repeatedly come into contact with titanium. This causes contamination by metallic elements which is harmful to characteristics of the product.

Still another contamination source is rust and fouling on the steel conveyor used for transportation of the titanium sponge grains from the crushing stage to the mixing stage. Minimizing the travel in such transportation, in addition to the abovementioned elimination of crushing and mixing, is therefore effective in prevention of contamination of the titanium sponge.

d) Preparation of Ingot

Titanium ingot is prepared by arc or electron-beam melting of sponge. Either process follows conventional conditions. Preferable parameters for arc melting are a vacuum of $10^{-2}$~$10^{-4}$ torr, a voltage of about 40 V and a current of 20–40 kA. Preferable parameters for electron-beam melting are a vacuum of $10^{-4}$~$10^{-5}$ torr and a power several tens of kilowatts which produces a melt at a temperature higher than the melting point by 100° C.

Sponge to be melted consists primarily of grains 10–300 mm in size, but may contain grains of other sizes incorporated inevitably during prior processing.

(2) Method of producing titanium material with a purity of five nines (99.999%) or higher Contamination of titanium sponge by Fe, Ni and Cr in the reduction and separation steps in the Kroll process is mediated by molten Mg in the reaction vessel. Detailed studies were made on contamination caused by the vessel.

Figure 4:
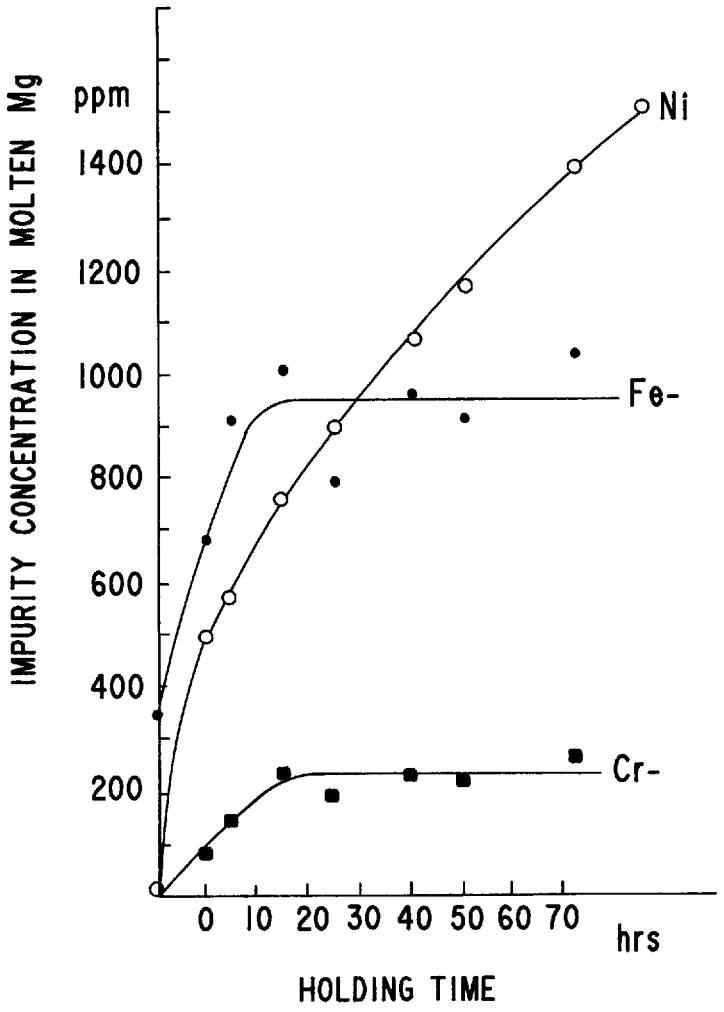
FIG. 4 shows contamination of molten Mg due to a reaction vessel made of austenitic stainless steel (SUS 304)

Contamination of molten Mg in a reaction vessel made of austenitic stainless steel (SUS 304) is seen in FIG. 4 which shows the time dependence of Fe, Ni and Cr concentrations in molten Mg at 800° C. held in a SUS 304 vessel 50 mm in inner diameter and 200 mm in effective height. Every metallic impurity clearly increases in the course of time; Fe and Cr concentrations saturate at certain levels, while Ni continues to be released into Mg without saturation. It is thus evident that these impurities released by the vessel into molten Mg is a source of contamination of titanium sponge.

Figure 5:
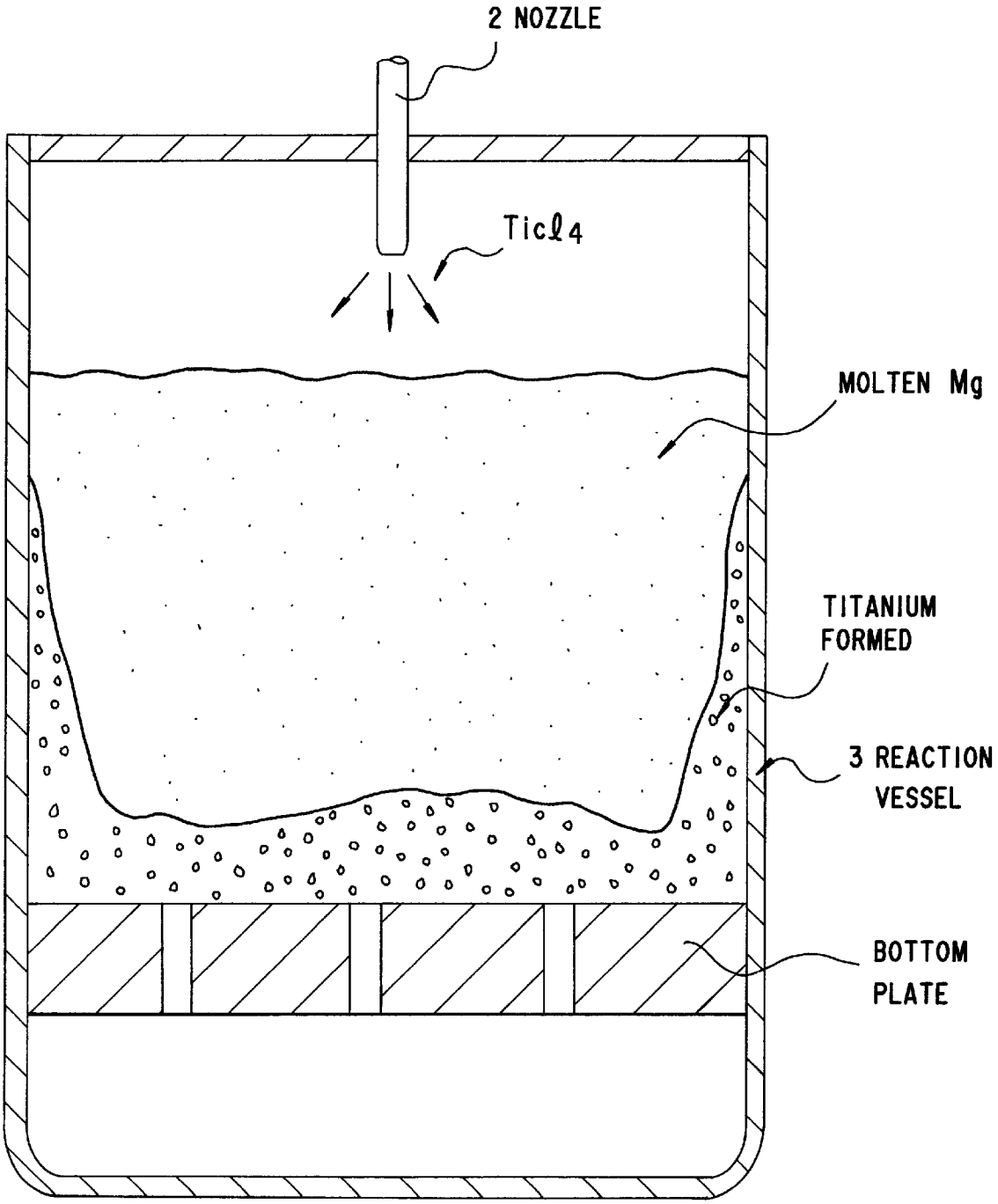
FIG. 5 illustrates the reaction in the vessel during the reduction stage.
Figure 6A:
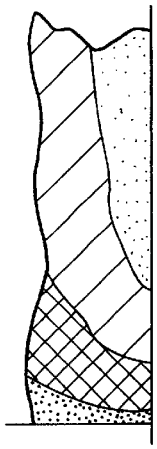
FIG. 6 represents the distribution of nickel and chromium in a cylindrical lump (6 tonnes in weight) after the reduction and vacuum separation processes in a vessel made of clad steel (austenitic stainless and low-carbon steels), as compared with that in a vessel of austenitic stainless steel (SUS 304), shown for a quarter around its central axis.
Figure 6B:
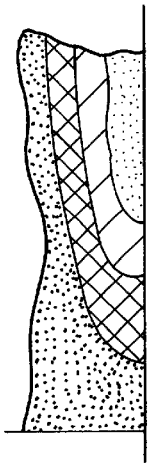
Figure 6B:
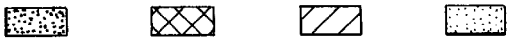
Figure 6C:
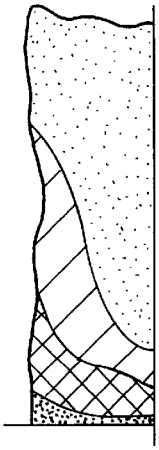
Figure 6D:
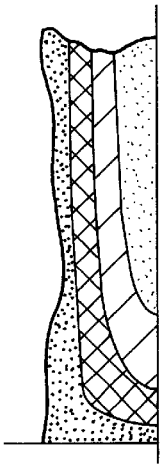
Figure 6D:
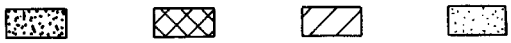

FIG. 5 illustrates the reaction in the vessel during the reduction stage. $TiCl_4$ dropped from a nozzle 2 is reduced by molten Mg, and the resultant titanium deposits first on a bottom plate in the vessel 3, then on the inner surface of the vessel 3 during the course of the reaction. Fe, Ni and Cr in molten Mg are incorporated in the titanium metal initially formed, thus decreasing the impurity concentration in the bulk of molten Mg. Thus the Fe, Ni and Cr concentrations in the core of titanium sponge formed in the middle part of the vessel are relatively low.

In the vacuum separation stage, the reaction vessel 3 is heated externally to about 1000° C. to evaporate unreacted Mg and the byproduct $MgCl_2$ remaining in the sponge. During this process Fe, Ni and Cr left by the evaporating Mg on the surface of the vessel and sponge may diffuse into the inside of the sponge, thus contaminating the latter. Some Fe, Ni and Cr contained in the vessel may also migrate into the sponge.

The release of impurities from the reaction vessel can be reduced by using a clad steel vessel, consisting of an outer shell of stainless steel with high strength at elevated temperatures and an inner shell, which comes into contact with molten Mg, of carbon steel containing less impurity elements, notably Ni and Cr.

FIG. 6 represents the distribution of Ni and Cr in a cylindrical lump (6 tonnes in weight) after reduction and separation in a vessel made of clad steel (SUS 304 L stainless steel outside and SS 400 carbon steel inside), as compared with that in a vessel of austenitic stainless steel (SUS 304 L), shown for a quarter around its central axis. Comparison shows that the clad-steel vessel leads to reduced Ni and Cr concentrations in titanium sponge. The reduction is particularly remarkable in the core of the sponge.

The present invention thus uses a reaction vessel made of clad steel, consisting of an outer shell of stainless steel and an inner shell of carbon steel, in the reduction and separation stages. The inner carbon steel is for reducing Ni and Cr release into molten Mg, and can be structural rolled steels (JIS SS 330–SS 540), carbon steels for boilers and pressure vessels (SB 410–SB 480), or sheet steels for pressure vessels (SPV 315–SPV 490). Low carbon steel is preferable to minimize effects of carbon. The outer stainless steel should preferably be austenitic for high strength at elevated temperatures, and can be, for example, JIS SUS 304, SUS 304 L, SUS 310, SUS 316, SUS 316 L, or SUS 321.

As stated in (1) above, high-purity titanium material with desired characteristics can be obtained by using only the core of the cylindrical titanium sponge extracted from the vessel in subsequent processing. The core for producing five-nine (99.999%) titanium material is defined as follows in relation to FIG. 3.

Namely, the core is to be obtained by cutting off from the lump a bottom portion 23 with a height more than 25% of that of the cylinder ($h_1 \geqq 0.25H$), a top portion 24 with a height more than 10% of that of the cylinder ($h_2 \geqq 0.10H$), and a peripheral portion 25 with a thickness more than 18% of the diameter of the cylinder ($w \geqq 0.18D$), thus leaving a core with a weight less than 30% of the cylindrical lump.

As in (1) above, crushing and mixing is eliminated also in the present case, and larger titanium sponge grains are directly used in the melting stage. Methods and conditions for arc or electron-beam melting are the same as used in (1) above.

(3) Method of producing titanium material with a purity of six nines (99.9999%) or higher As described above, four-nine (99.99%) or five-nine (99.999%) titanium ingot can be produced directly from the Kroll sponge. The present section (3) discusses purification by the widely used iodine process to obtain six-nine (99.9999%) titanium material.

Figure 7:
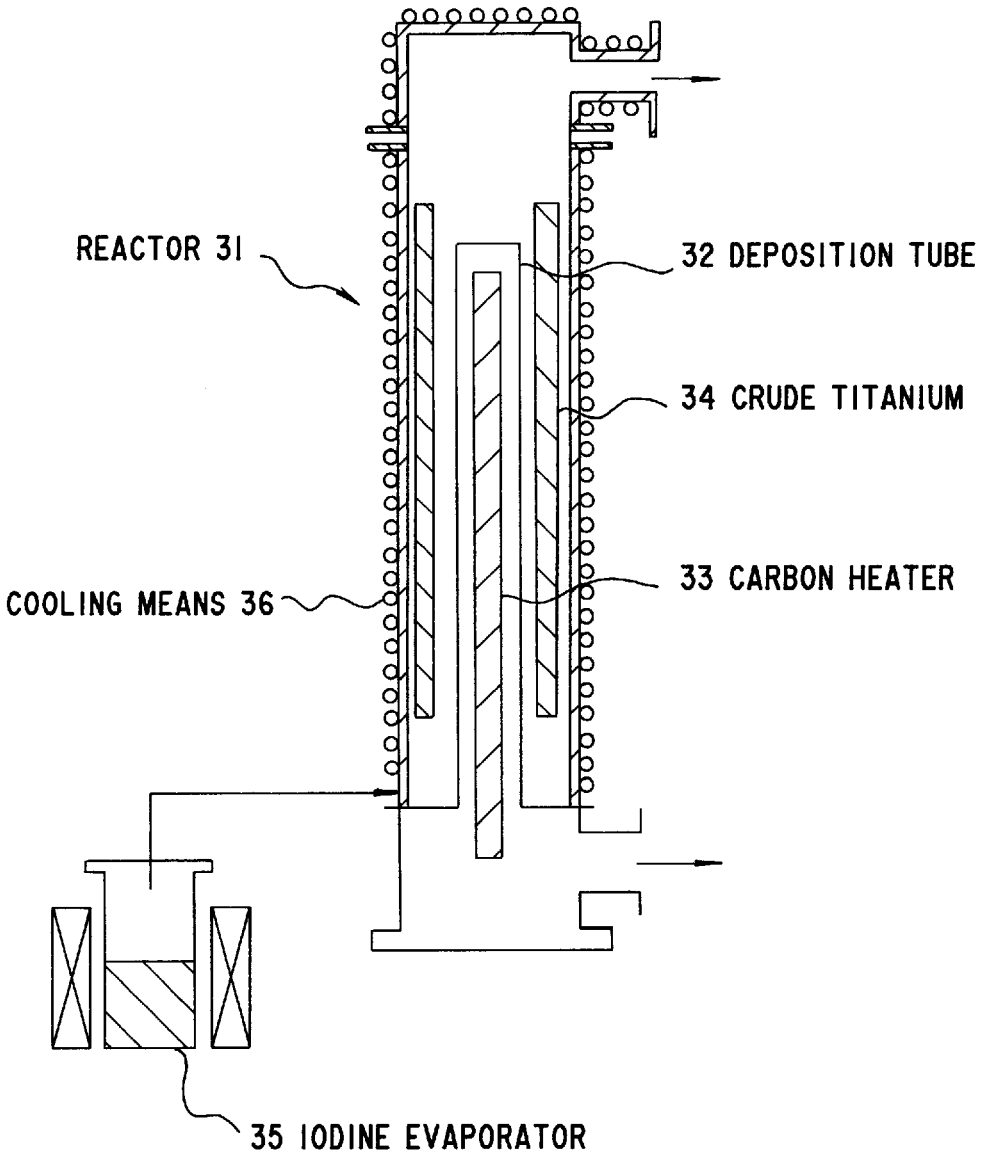
FIG. 7 shows a vertical section of an apparatus for producing high-purity titanium by the iodine process.

FIG. 7 shows a vertical section of an apparatus for producing high-purity titanium by the iodine process. The cylindrical reaction vessel 31 has a deposition tube 32 located at the central axis, in the inside of which a carbon heater 33 is provided. Crude titanium 34 is placed in the vessel 31 so as to surround the deposition tube 32. After the vessel 31 is evacuated and heated by the carbon heater 33, iodine from an iodine evaporator 35 is introduced into the vessel 31, whereupon reactions ① and ② below occur:

$$\textit{Crude Ti} + 2I_2 \rightarrow TiI_4 \text{ (Synthetic reaction)} \quad ①$$

$$TiI_4 \rightarrow \textit{High-purity Ti} + 2I_2 \text{ (Thermal decomposition reaction)} \quad ②$$

The synthetic reaction proceeds in the periphery of the vessel where crude titanium is placed, whereas the thermal decomposition reaction occurs on the deposition tube at the center of the vessel. Iodine formed by the thermal decomposition of $TiI_4$ diffuses toward the peripheral part of the vessel and is reused in the synthetic reaction. Thus, in the iodine process, high-purity titanium deposits continuously on the deposition tube as a result of the thermal decomposition of $TiI_4$ formed in the synthetic reaction of crude Ti and iodine in the periphery of the vessel.

Another example of methods of producing high-purity titanium by the iodine process is disclosed in JP4-246136 (U.S. Pat. No. 5,232,485), in which a titanium tube serves as the deposition tube; crude titanium is reacted with $TiI_4$ to produce titanium subiodide (including $TiI_2$ and $TiI_3$), which is subsequently decomposed to deposit high-purity titanium. Reactions ③ and ④ are assumed to occur in the reaction vessel:

$$\textit{Crude Ti}+TiI_4 \rightarrow 2TiI_4 \text{ (Synthetic reaction)} \quad ③$$

$$2TiI_2 \rightarrow \textit{High-purity Ti}+TiI_4 \text{ (Thermal decomposition reaction)} \quad ④$$

Impurities in crude titanium migrate to its surface in the course of reaction and are eventually concentrated in gaseous TiI or $TiI_4$, thus contaminating the deposited titanium. Furthermore, since the thermal decomposition occurring on the deposition tube is exothermic, the temperature in the vessel tends to be high. The reaction vessel 31 has usually a cooling means 36 to control the temperature, because higher reaction temperatures would prompt release of impurities in $TiI_4$ or $TiI_2$ through thermal decomposition, causing excessive contamination of the deposited titanium.

As explained above, purity of the titanium deposited by the iodine process depends on that of crude titanium. Therefore, reacting iodine or $TiI_4$ with high-purity titanium produced by the Kroll process to form titanium iodide or titanium subiodide and subsequently decomposing the latter is a process suitable for obtaining titanium material of still higher purity.

According to the present invention, the reaction vessel used in the Kroll process is made of clad steel consisting of an outer shell of stainless steel and an inner shell of carbon steel in order to obtain crude titanium of sufficiently high purity for refining in the iodine process. The inner carbon steel is for reducing Ni and Cr release into molten Mg, and can be structural rolled steels (JIS SS 330–SS 540), carbon steels for boilers and pressure vessels (SB 410–SB 480), or sheet steels for pressure vessels (SPV 315–SPV 490). Low carbon steel is preferable to minimize effects of carbon. The outer stainless steel should preferably be austenitic for high strength at elevated temperatures, and can be, for example, JIS SUS 304, SUS 304 L, SUS 310, SUS 316, SUS 316 L, or SUS 321. As stated earlier, high-purity titanium material with desired characteristics can be obtained by using only the core of the cylindrical titanium sponge obtained by the Kroll process. The core for producing six-nine (99.9999%) titanium material is defined as follows in relation to FIG. 3.

Namely, the core is to be obtained, as in (2) above, by cutting off from the lump a bottom portion 23 with a height more than 25% of that of the cylinder ($h_1 \geqq 0.25H$), a top portion 24 with a height more than 10% of that of the cylinder ($h_2 \geqq 0.10H$), and a peripheral portion 25 with a thickness more than 18% of the diameter of the cylinder ($w \geqq 0.18D$), thus leaving a core with a weight less than 30% of the cylindrical lump.

The core used as the crude titanium for purification is chosen according to the desired characteristics of the purified product. Purification of the core with a weight less than 30% of that of the whole lump, as described earlier, provides six-nine (99.9999%) titanium material containing less than 200 ppm $O_2$ and less than 1 ppm each of Fe, Ni, Cr, Al and Si.

The reaction vessel used in the iodine process is preferably made of stainless steel (such as SUS 304, SUS 304 L, SUS 310, SUS 316) which usually has lining of Ti, Ta or Mo covering the whole inner surface to prevent contamination by Fe, Ni or Cr contained in the vessel. Direct contact of the vessel surface with iodine would form Fe or Cr iodide which evaporates and precipitates with titanium resulting in contamination of the latter. A cooling means is provided on the outer surface of the vessel to control reaction temperature, because excessively high temperatures in the vessel may, as described above, result in heavy contamination of deposited titanium. On the other hand, too low temperature would retard the thermal decomposition of $TiI_4$, leading to a low yield. The temperature in the vessel is thus chosen to 700°–900° C.

EXAMPLES

Advantages of the invention are described below in terms of examples, referring to FIG. 3.

EXAMPLE 1

Cylindrical lumps of titanium sponge, 2000 mm in height, 1500 mm in diameter and about 6 tonne in weight after vacuum separation, were produced in the Kroll process using a reaction vessel made of SUS 304 steel. Sponges A, B and C representing embodiments of the present invention and sponges D and E as comparative examples were separated from the lumps according to the conditions described below as the starting materials for consumable electrodes used in melting.

1. Sponge A

A core was obtained by cutting off from the lump a bottom portion 650 mm in height $h_1$ (33% of the lump height), a top portion 280 mm in height $h_2$ (14% of the lump height), and a peripheral portion 450 mm in thickness w (30% of the lump diameter), thus leaving a core with a weight of 10% of the lump (1070 mm in height at the center, 600 mm in diameter and 600 kg in weight), which was then cut by a press into grains 10–300 mm in size.

2. Sponge B

A core was obtained by cutting off from the lump a bottom portion 550 mm in height $h_1$ (28% of the lump height), a top portion 250 mm in height $h_2$ (13% of the lump height), and a peripheral portion 350 mm in thickness w (23% of the lump diameter), thus leaving a core with a weight of 20% of the lump (1200 mm in height at the center, 800 mm in diameter and 1200 kg in weight), which was then cut by a press into grains 10–300 mm in size.

3. Sponge C

As Sponge B above, a core with a weight of 20% of the lump (1200 mm in height at the center, 800 mm in diameter and 1200 kg in weight) was separated and then cut by a press into grains 200–300 mm in size.

4. Sponge D

A core was obtained by cutting off from the lump a bottom portion 330 mm in height $h_1$ (16% of the lump height), a top portion 250 mm in height $h_2$ (13% of the lump height), and a peripheral portion 300 mm in thickness w (20% of the lump diameter), thus leaving a core with a weight of 30% of the lump (1420 mm in height at the center, 900 mm in diameter and 1800 kg in weight), which was then cut by a press into grains 10–300 mm in size.

5. Sponge E

As Sponge B above, a core with a weight of 20% of the lump (1200 mm in height at the center, 800 mm in diameter and 1200 kg in weight) was separated and then cut by a press into grains 10–300 mm in size. The grains were further crushed into ½ inch-20 mesh fine grains by a jaw crusher and mixed in a blender.

Each of the titanium sponges A-E described above was processed into consumable electrode which was then arc-melted to produce ingot. The purity of the ingot was determined for each sponge. Results are summarized in Table 1.

TABLE 1

| | No | Product | Chemical composition in ppm; balance = Ti Fe | Ni | Cr | Al | Si | O | Remarks (Pecularities in process) |
|---|---|---|---|---|---|---|---|---|---|
| Examples according to the invention | A | Titanium sponge | 4 | 3 | 3 | <5 | <10 | 261 | Cut into grains |
| | | Titanium ingot | 6 | 3 | 3 | <5 | <10 | 280 | 10–300 mm in size |
| | B | Titanium sponge | 8 | 10 | 10 | <10 | <10 | 280 | Cut into grains |
| | | Titanium ingot | 10 | 10 | 10 | <10 | <10 | 290 | 10–300 mm in size |
| | C | Titanium sponge | 7 | 10 | 10 | <10 | <10 | 280 | Cut into grains |
| | | Titanium ingot | 9 | 10 | 10 | <10 | <10 | 290 | 200–300 mm in size |
| Comparative examples | D | Titanium sponge | 120 | 20 | 20 | 30 | 20 | 330 | Core weight 30% |
| | | Titanium ingot | 130 | 20 | 20 | 30 | 20 | 340 | whole sponge |
| | E | Titanium sponge | 40 | 20 | 20 | 20 | 20 | 320 | Cut into grains 10–300 |
| | | Titanium ingot | 50 | 20 | 20 | 20 | 20 | 340 | mm in size followed by crushing and mixing |

Note:
<5 and <10 mean content less than 5 ppm and 10 ppm, respectively.

Table 1 clearly shows that the titanium sponges and ingots according to the invention have very low levels of impurities compared with those in comparative examples. In addition, the purity of the ingots according to the invention is four nines (99.99%), containing less than 300 ppm of $O_2$ and less than 10 ppm each of Fe, Ni, Cr, Al and Si.

EXAMPLE 2

Cylindrical lumps of titanium sponge, 2000 mm in height, 1500 mm in diameter and about 6 tonne in weight after vacuum separation, were produced in the Kroll process using a reaction vessel made of clad steel (SUS 304 L stainless steel outside/SS 400 carbon steel inside). Sponges F, G and H representing embodiments of the present invention and sponges I, J and K as comparative examples were separated from the lumps according to the conditions described below as the starting materials for consumable electrodes used in melting. The clad-steel vessel was not used for one of the comparative examples (Sponge K).

6. Sponge F

A core was obtained by cutting off from the lump a bottom portion 550 mm in height $h_1$ (28% of the lump height), a top portion 250 mm in height $h_2$ (13% of the lump height), and a peripheral portion 350 mm in thickness w (23% of the lump diameter), thus leaving a core with a weight of 20% of the lump (1200 mm in height at the center, 800 mm in diameter and 1200 kg in weight), which was then cut by a press into grains 10–300 mm in size.

7. Sponge G

A core was obtained by cutting off from the lump a bottom portion 500 mm in height $h_1$ (25% of the lump height), a top portion 240 mm in height $h_2$ (12% of the lump height), and a peripheral portion 300 mm in thickness w (20% of the lump diameter), thus leaving a core with a weight of 25% of the lump (1260 mm in height at the center, 900 mm in diameter and 1500 kg in weight), which was then cut by a press into grains 10–300 mm in size.

8. Sponge H

As Sponge G above, a core with a weight of 25% of the lump (1260 mm in height at the center, 900 mm in diameter and 1500 kg in weight) was separated and then cut by a press into grains 200–300 mm in size.

9. Sponge I

A core was obtained by cutting off from the lump a bottom portion 330 mm in height $h_1$ (16% of the lump height), a top portion 250 mm in height $h_2$ (13% of the lump height), and a peripheral portion 225 mm in thickness w (15% of the lump diameter), thus leaving a core with a weight of 35% of the lump (1420 mm in height at the center, 1050 mm in diameter and 2100 kg in weight), which was then cut by a press into grains 10–300 mm in size.

10. Sponge J

As Sponge G above, a core with a weight of 25% of the lump (1260 mm in height at the center, 900 mm in diameter and 1500 kg in weight) was separated and then cut by a press into grains 10–300 mm in size. The grains were further crushed into ½ inch-20 mesh fine grains by a jaw crusher and mixed in a blender.

11. Sponge K

A cylindrical lump of titanium sponge, about 6 tonne in weight after vacuum separation, was produced in the Kroll process using a reaction vessel made of SUS 304 steel, from which, as Sponge G above, a core with a weight of 25% of the lump (1260 mm in height at the center, 900 mm in diameter and 1500 kg in weight) was separated and then cut by a press into grains 10–300 mm in size.

Each of titanium sponges F-K described above was used to produce ingot by arc or electron-beam melting. The purity of the sponges and ingots were determined and are summarized in Table 2. The ingots AC and EB in the table indicate arc-melted and electron beam-melted ingots, respectively.

TABLE 2

| | No | Product | Chemical composition in ppm; balance = Ti Fe | Ni | Cr | Al | Si | O | Remarks (Pecularities in process) |
|---|---|---|---|---|---|---|---|---|---|
| Examples according to the invention | F | Titanium sponge | 4 | 3 | 3 | <5 | <10 | 261 | Cut into grains |
| | | Titanium ingot AC | 6 | 3 | 3 | <5 | <10 | 280 | 10–300 mm in size |
| | | Titanium ingot EB | 2 | 2 | 2 | <5 | <10 | 261 | |
| | G | Titanium sponge | 8 | 10 | 10 | <10 | <10 | 280 | Cut into grains |
| | | Titanium ingot AC | 10 | 10 | 10 | <10 | <10 | 290 | 10–300 mm in size |
| | | Titanium ingot EB | 6 | 5 | 5 | <10 | <10 | 280 | |
| | H | Titanium sponge | 7 | 10 | 10 | <10 | <10 | 270 | Cut into grains |
| | | Titanium ingot AC | 9 | 10 | 10 | <10 | <10 | 280 | 200–300 mm in size |
| | | Titanium ingot EB | 5 | 5 | 6 | <10 | <10 | 270 | |
| Comparative examples | I | Titanium sponge | 120 | 20 | 20 | 30 | 20 | 330 | Core weight 35% |
| | | Titanium ingot AC | 130 | 20 | 20 | 30 | 20 | 340 | whole sponge |
| | | Titanium ingot EB | 90 | 16 | 15 | 16 | 16 | 330 | |
| | J | Titanium sponge | 40 | 20 | 20 | 20 | 20 | 320 | cut into grains |
| | | Titanium ingot AC | 50 | 20 | 20 | 20 | 20 | 340 | 10–300 mm in size |
| | | Titanium ingot EB | 30 | 14 | 16 | 16 | 16 | 320 | follwed by crushing and mixing |
| | K | Titanium sponge | 8 | 30 | 30 | <5 | <10 | 261 | Reaction vessel made |
| | | Titanium ingot AC | 10 | 30 | 30 | <5 | <10 | 270 | of SUS 304 L instead |
| | | Titanium ingot EB | 6 | 20 | 20 | <5 | <10 | 261 | of clad steel |

Note:
(1) <5 and <10 mean content less than 5 ppm and 10 ppm, respectively.
(2) Titanium ingot AC produced by arc melting. Titanium ingot EB by electron-beam melting Table 2 clearly shows that the titanium sponges and ingots according to the invention have far lower impurity levels than those in comparative examples. In addition, the purity of the ingots according to the invention is five nines (99.999%), containing less than 300 ppm of $O_2$ and less than 10 ppm each of Fe, Ni, Cr, Al and Si.

EXAMPLE 3

Three sponges F, G and H in Example 2 above were refined by the iodine process using an apparatus shown in FIG. 7. The purity of crude and purified titanium materials were determined and are summarized in Table 3.

TABLE 3

| | No | Titanium sponge used | Product | Chemical composition in ppm; balance = Ti Fe | Ni | Cr | Al | Si | O |
|---|---|---|---|---|---|---|---|---|---|
| Examples according to the invention | 1 | Sponge F | Titanium sponge | 4 | 3 | 3 | <5 | <10 | 261 |
| | | | Purified titanium | 0.2 | 0.1 | 0.1 | 0.3 | 0.2 | 180 |
| | 2 | Sponge G | Titanium sponge | 8 | 10 | 10 | <10 | <10 | 280 |
| | | | Purified titanium | 0.6 | 0.4 | 0.3 | 0.8 | 0.6 | 180 |
| | 3 | Sponge H | Titanium sponge | 7 | 10 | 10 | <10 | <10 | 280 |
| | | | Purified titanium | 0.4 | 0.4 | 0.3 | 0.8 | 0.6 | 150 |

Note:
<5 and <10 mean content less than 5 ppm and 10 ppm, respectively.

Results shown in Table 3 are compared with the arc-melted (AC) and electron beam-melted (EB) ingots from Sponges F, G and H shown in Table 2. The purified materials according to the invention show far lower impurity levels than those in comparative examples. Purification by the iodine process provides six-nine (99.9999%) titanium material, containing less than 200 ppm of $O_2$ and less than 1 ppm each of Fe, Ni, Cr, Al and Si.

As described so far, Processes (1) and (2) according to the invention allow production of high-purity titanium materials suitable for thin film deposition as wiring of LSIs from titanium sponge obtained by the Kroll process. Furthermore, Process (3) provides, through refining sponge obtained by the Kroll process, titanium materials of very high purity suitable for targets used for thin film deposition as wiring of 16-, 64- and 256-megabit devices, or even 1-gigabit devices.

We claim:

1. A method for producing high-purity titanium from a cylindrical lump of titanium sponge obtained by the Kroll process comprising separating a core of the cylindrical lump of said sponge with a weight less than 20% of that of said lump by cutting off from said lump a bottom portion with a height more than 25% of that of said lump, a top portion with a height more than 10% of that of said lump, and a peripheral portion with a thickness more than 20% of the diameter of said lump; cutting said core of said sponge by a press into grains 10–300 mm in size; and melting said grains into ingot.

2. A method for producing high-purity titanium from titanium sponge obtained by the Kroll process as claimed in claim 1, in which said core of said sponge is cut by a press into grains 200–300 mm in size.

3. A method for producing high-purity titanium from titanium sponge obtained by the Kroll process as claimed in claim 1 in which the resultant high-purity titanium contains less than 300 ppm of oxygen and less than 10 ppm each of iron, nickel, chromium, aluminum and silicon, the balance being titanium and inevitable impurities.

4. A method for producing high-purity titanium from titanium sponge obtained by the Kroll process as claimed in claim 1 in which the weight of said cylindrical lump of titanium sponge is 6–10 tonnes.

5. A method for producing high-purity titanium from titanium sponge obtained by the Kroll process as claimed in claim 1 in which said grains are arc-melted into ingot.

6. A method for producing high-purity titanium from titanium sponge obtained by the Kroll process as claimed in claim 1 in which said grains are electron beam-melted into ingot.

7. A method for producing high-purity titanium from a cylindrical lump of titanium sponge obtained by the Kroll process in which reduction and vacuum separation are performed using a reaction vessel made of clad steel, the method comprising separating a core of the cylindrical lump of said sponge with a weight less than 30% of that of said lump by cutting off from said lump a bottom portion with a height more than 25% of that of said lump, a top portion with a height more than 10% of that of said lump, and a peripheral portion with a thickness more than 18% of the diameter of said lump; cutting said core of said sponge by a press into grains 10–300 mm in size; and melting said grains into ingot.

8. A method for producing high-purity titanium from titanium sponge obtained by the Kroll process as claimed in claim 7, in which said core of said sponge is cut by a press into grains 200–300 mm in size.

9. A method for producing high-purity titanium from titanium sponge obtained by the Kroll process as claimed in claim 7 in which the resultant high-purity titanium contains less than 300 ppm of oxygen and less than 10 ppm each of iron, nickel, chromium, aluminum and silicon, the balance being titanium and inevitable impurities.

10. A method for producing high-purity titanium from titanium sponge obtained by the Kroll process as claimed in claim 7 in which said reaction vessel made of clad steel has an inner part of low-carbon steel and an outer part of austenitic stainless steel.

11. A method for producing high-purity titanium from titanium sponge obtained by the Kroll process as claimed in claim 7 in which the weight of said cylindrical lump of titanium sponge is 6–10 tonnes.

12. A method for producing high-purity titanium from titanium sponge obtained by the Kroll process as claimed in claim 7 in which said grains are arc-melted into ingot.

13. A method for producing high-purity titanium from titanium sponge obtained by the Kroll process as claimed in claim 7 in which said grains are electron beam-melted into ingot.

14. A method for producing high-purity titanium from a cylindrical lump of titanium sponge obtained by the Kroll process in which reduction and vacuum separation are performed using a reaction vessel made of clad steel; the method comprising separating a core of the cylindrical lump of said sponge with a weight less than 30% of that of said lump by cutting off from said lump a bottom portion with a height more than 25% of that of said lump, a top portion with a height more than 10% of that of said lump, and a peripheral portion with a thickness more than 18% of the diameter of said lump; cutting said core of said sponge by a press into grains 10–300 mm in size; and refining said grains by reaction with iodine to produce titanium iodides and decomposition of the resultant titanium iodides.

15. A method for producing high-purity titanium from titanium sponge obtained by the Kroll process as claimed in claim 14, in which said core of said sponge is cut by a press into grains 200–300 mm in size.

16. A method for producing high-purity titanium from titanium sponge obtained by the Kroll process as claimed in claim 14 in which the resultant high-purity titanium contains less than 200 ppm of oxygen and less than 1 ppm each of iron, nickel, chromium, aluminum and silicon, the balance being titanium and inevitable impurities.

17. A method for producing high-purity titanium from titanium sponge obtained by the Kroll process as claimed in claim 14 in which said reaction vessel made of clad steel has an inner part of low-carbon steel and an outer part of austenitic stainless steel.

18. A method for producing high-purity titanium from titanium sponge obtained by the Kroll process as claimed in claim 14 in which the weight of said cylindrical lump of titanium sponge is 6–10 tonnes.

* * * * *